US006647905B2

(12) United States Patent
Fransing et al.

(10) Patent No.: US 6,647,905 B2
(45) Date of Patent: Nov. 18, 2003

(54) BUTTONHOLE SEWING MACHINE

(75) Inventors: Heinz Fransing, Melle (DE); Andreas Oberndörfer, Bielefeld (DE); Theodor Janocha, Bielefeld (DE)

(73) Assignee: Dürkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 10/410,467

(22) Filed: Apr. 9, 2003

(65) Prior Publication Data

US 2003/0192463 A1 Oct. 16, 2003

(30) Foreign Application Priority Data

Apr. 16, 2002 (DE) ..... 102 16 810

(51) Int. Cl.[7] ..... D05B 3/08
(52) U.S. Cl. ..... 112/66; 112/73
(58) Field of Search ..... 112/66, 65, 68, 112/70, 73, 76, 446, 447, 448, 449, 475.25

(56) References Cited

U.S. PATENT DOCUMENTS 6,095,066 A 8/2000 Nöltge et al.
6,105,519 A * 8/2000 Kastrup ..... 112/66
6,205,939 B1 * 3/2001 Janocha et al. ..... 112/73

FOREIGN PATENT DOCUMENTS

DE 299 12 970 10/1999

OTHER PUBLICATIONS

JUKI Corporation, 2000–2001, JUKI MEB–3200, Instruction Manual Leaflet No. 0229343316.

* cited by examiner

*Primary Examiner*—Peter Nerbun
(74) *Attorney, Agent, or Firm*—McGlew and Tuttle, P.C.

(57) ABSTRACT

A buttonhole sewing machine comprises work piece clamps with displacement drives for displacement from an initial position of spread by a length of spread into a final position of spread. The work piece clamp comprises a supporting plate for accommodation of a work piece and a clamping plate mounted on the supporting plate. A clamping drive for actuation of the clamping plate supports itself on the supporting plate.

4 Claims, 5 Drawing Sheets

BUTTONHOLE SEWING MACHINE

BACKGROUND OF THE INVENTION

1. Field of the Invention

The invention relates to a buttonhole sewing machine comprising a needle drivable via an arm shaft; an x-y table, which is movable by an x drive in an x direction and by a y drive in a y direction. which supports a first and a second work piece clamp mounted for displacement one relative to the other, and which comprises a displacement drive for displacing the work piece clamps relative to each other from an initial position of spread by a length of spread into a final position of spread.

2. Background Art

The JUKI MEB-3200 Instruction Manual leaflet no. 02 29343316 describes a buttonhole sewing machine of the generic type. It comprises an x-y table which is displaceable on the sewing plane by two stepper motors as x and y drives. Two work piece clamps arc disposed on the x-y table, holding a work piece thereon. By means of a pneumatic cylinder, they are displaceable in the x direction on the sewing plane, which is formed by the x-y plane, in mirror symmetry to a center plane. Both pneumatic cylinders are operable by means of a control command that is stored in the control unit. Provided on each side of the x-y table are setscrews, enabling the length of spread of each work piece clamp to be set from a non-modifiable inner initial position of spread to a final position of spread.

Shifting the work piece clamps enables the tightly clamped work piece to be stretched and spread into a tautened plain position. It is possible in this way to produce high quality buttonholes. Spreading the work piece also creates sufficient room for the needle, in case the buttonhole is first cut and then sewn i.e., with the sewing machine working in a so-called preconditioning mode. The displacement of each work piece clamp is in the range of 1.0 mm so that the clamps can be moved apart by a length of spread of 2.0 mm. The length of spread depends on various sewing parameters such as the structure of the work piece i.e., material, thickness and the like, the kind of threads used for sewing, thread tightening, needle size, possible use of a gimp thread and further parameters.

Drawbacks of this known machine reside in that the work piece clamps must be made rather solid if not, they would be warped by the clamping forces that occur. Considerable frictional forces occur upon spreading, which must be overcome by the displacement drive for execution of the spreading motion.

SUMMARY OF THE INVENTION

It is an object of the invention to develop a buttonhole sewing machine of the generic type for as simple a design as possible of the at least one work piece clamp.

According to the invention. this object is attained by at least the first work piece clamp comprising a supporting plate for accommodation of a work piece and a clamping plate which is mounted on the supporting plate; and by a clamping drive for actuation of the clamping plate supporting itself on the supporting plate.

The measures according to the invention help ensure that, at least by the displaceable work piece clamp, no forces are transmitted to the guides of the work piece clamp on the x-y table. No frictional forces that might oppose the displacement of the work piece clamp for spreading are occasioned in positioning the work piece clamp. The forces that occasion when a work piece is clamped are kept within the work piece clamp itself. This works in favor of the rapidity and accuracy of the spreading job. Lightweight construction of the entire spreading arrangement is possible, reducing material consumption.

Details of the invention will become apparent from the ensuing description of three exemplary embodiments, taken in conjunction with the drawing.

DESCRIPTION OF THE PREFERRED EMBODIMENTS

Figure 1:
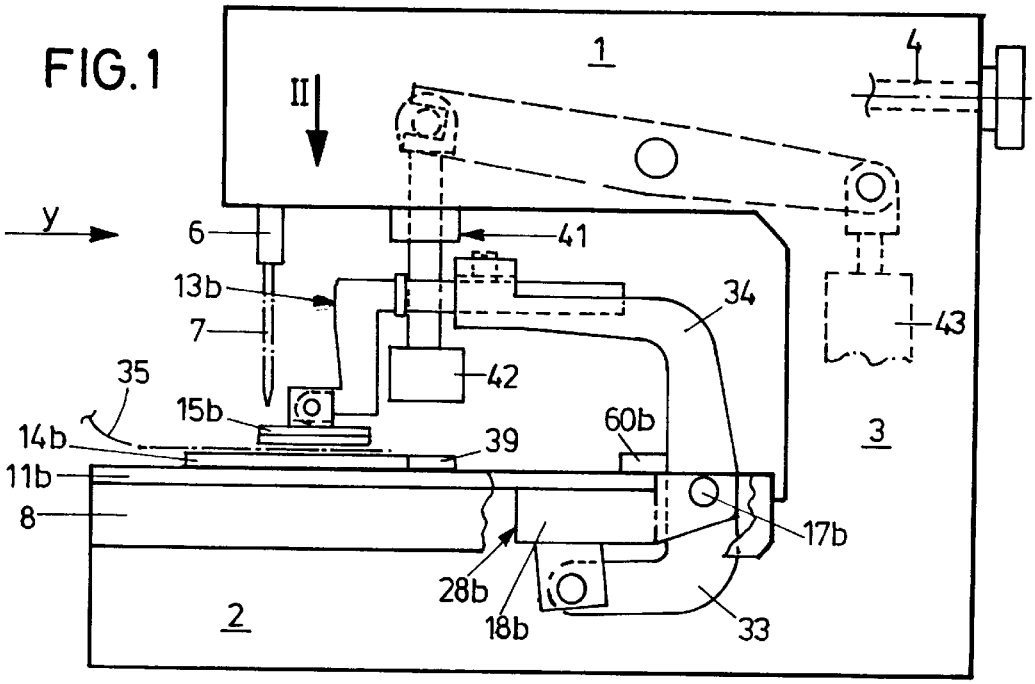
FIG. 1 is a side view of a buttonhole sewing machine.
Figure 2:
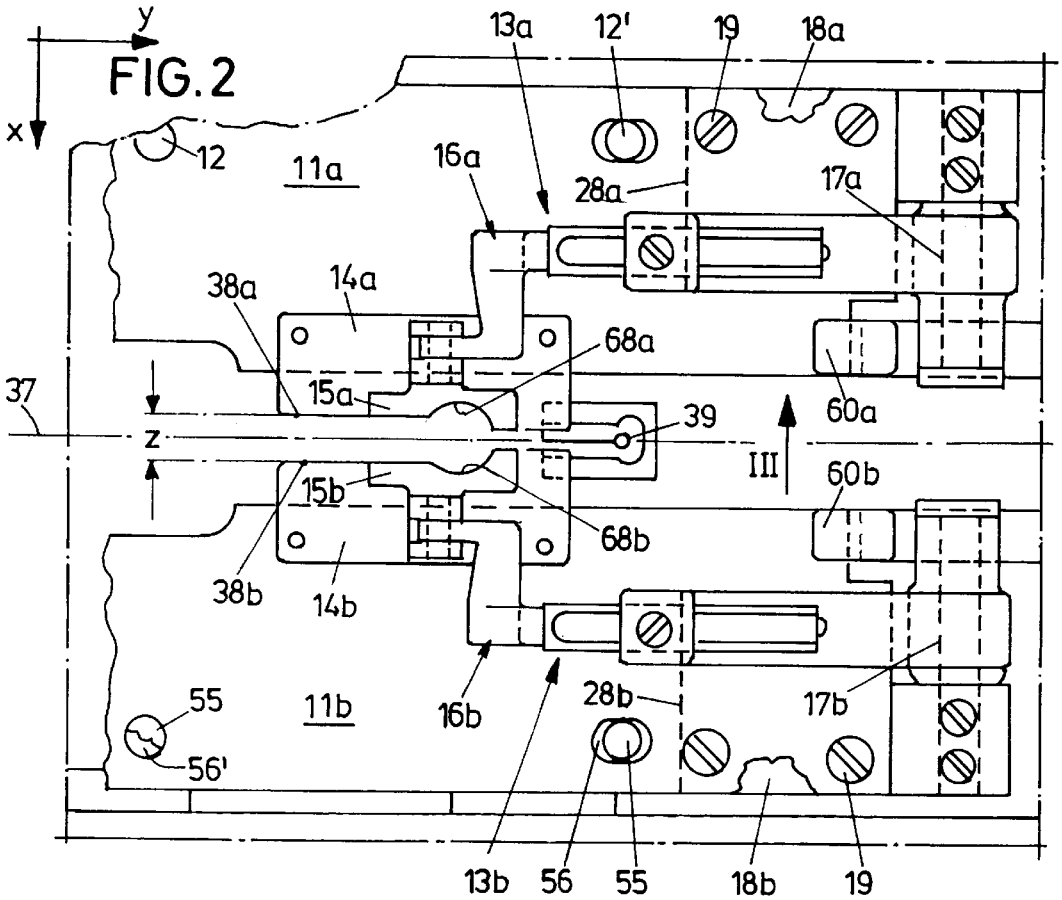
FIG. 2 is a partial plan view of an x-y table of the sewing machine in accordance with the arrow II of FIG. 1.
Figure 3:
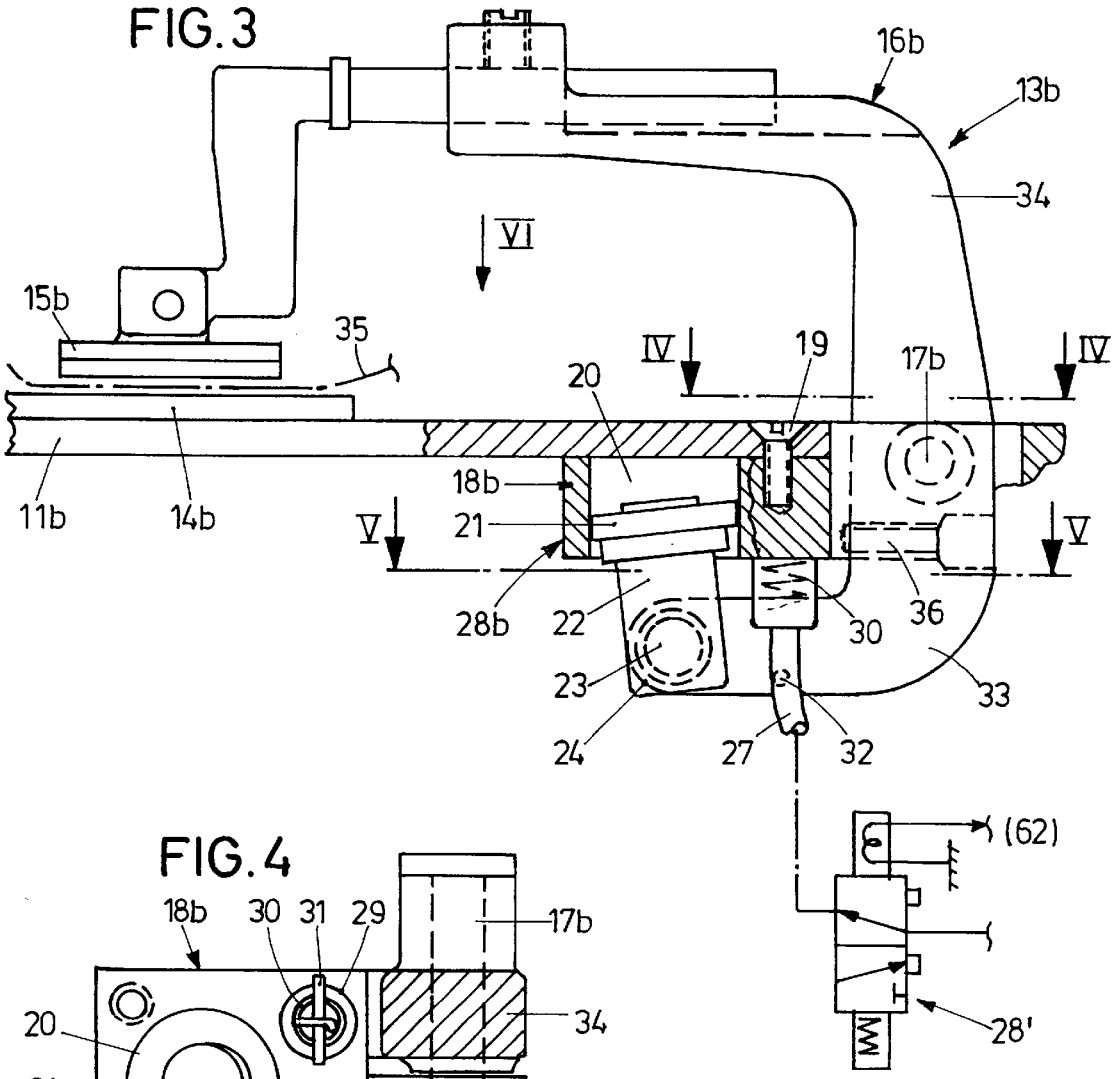
FIG. 3 is a partial side view of the sewing machine on an enlarged scale.
Figure 4:
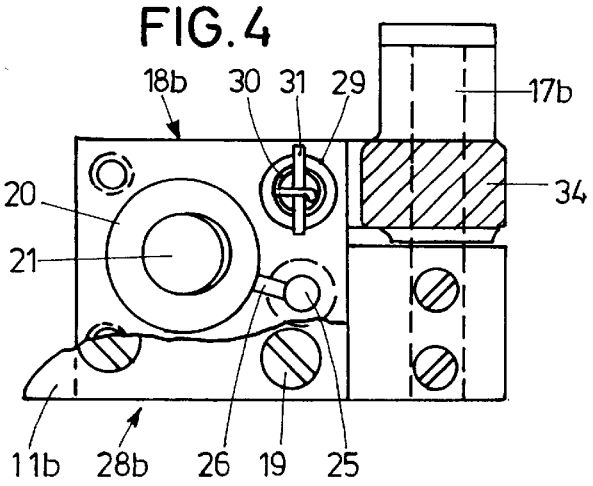
FIG. 4 is a view on the line IV—IV of FIG. 3.
Figure 5:
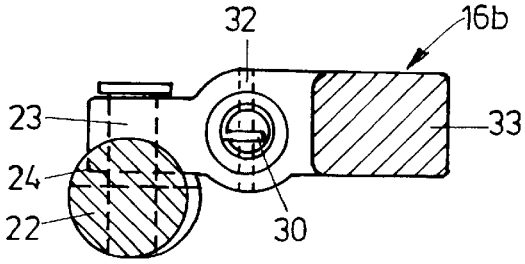
FIG. 5 is a partial cross-sectional view of the sewing machine on the line V—V of FIG. 3.
Figure 8:
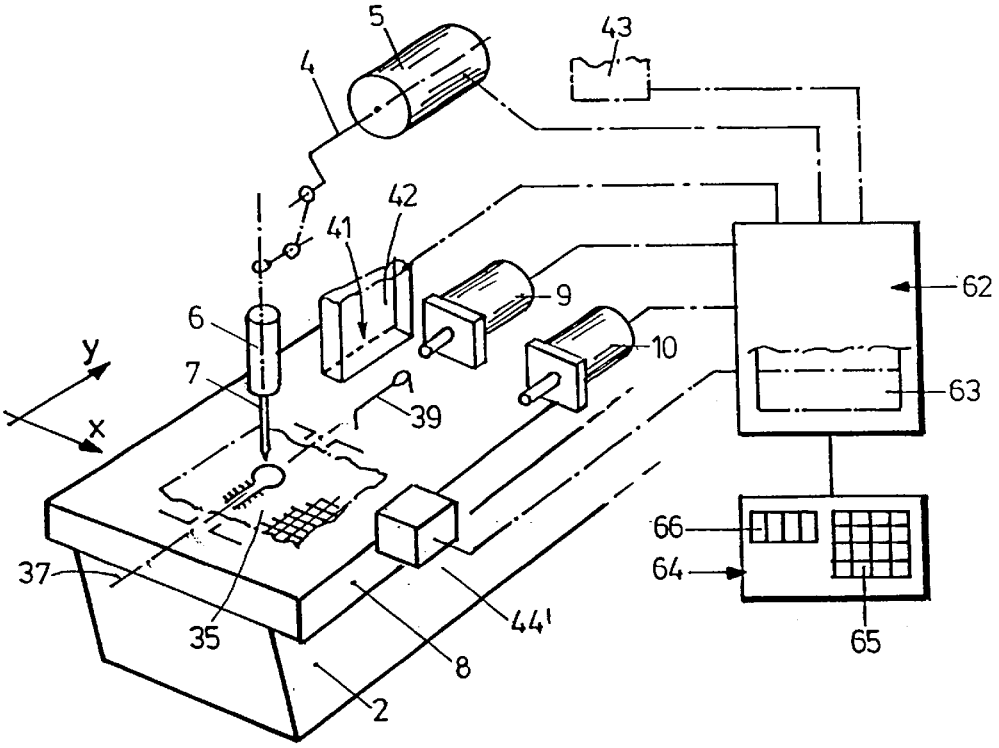
FIG. 8 is a perspective view of part of the buttonhole sewing machine inclusive of the linkage in circuit of the various drives to the control unit and the operating unit.

As seen in FIG. 1, a buttonhole sewing machine is C shaped, having a top arm 1, a bottom base plate 2 in the form of a casing and an approximately vertical standard 3 that unites the two. An arm shaft 4 is conventionally lodged in the arm 1; it is drivable by a motor 5 which is only roughly outlined in FIG. 8. The actuation of a vertically displaceable needle bar 6 with a needle 7 and a jogging drive therefor customarily derive from the arm shaft 4.

Disposed on the base plate 2 is an x-y table 8 which is a cross slide that is movable in two horizontal coordinate directions, namely the x and the y direction. The x-y table 8 is of conventional design as known for example from U.S. Pat. No. 6,095,066. Actuation of the x-y table 8 takes place by drives roughly outlined only in FIG. 8, namely an x drive 9 and a y drive 10 which are electric positioning motors, preferably stepper motors, or controllable D.C. motors.

A two-piece supporting plate 11*a*, 11*b* is disposed on the x-y table 8. The sectional supporting plate 11*a* on the left—seen in the y direction—is fixed to the x-y table 8 by positioning devices 12, 12'. The positioning devices 12, 12' are formed by recesses in the sectional supporting plate 11*a* and by pins which are tightly mounted on the x-y table 8. The sectional supporting plate 11*a* is non-displaceable in relation to the x-y table 8. The sectional supporting plate 11*b* on the right—seen in the y direction—is supported for displacement in the x direction on the x-y table 8. The top surfaces of the sectional supporting plate 11*a*, 11*b* are on a joint x-y plane.

Mounted on each sectional supporting plate 11*a* and 11*b* is a work piece clamp 13*a* and 13*b*, comprising a sectional bearing plate 14*a* and 14*b* which is mounted on the respective sectional supporting plate 11*a* and 11*b* and to each of which is allocated a clamping plate 15*a* and 15*b*. The clamping plates 15*a*, 15*b* are mounted on double-armed bearing levers 16*a*, 16*b*.

Each double-armed bearing lever 16*a*, 16*b*is lodged in a drive and bearing housing 18*a*, 18*b* by means of a pivot bearing 17*a*, 17*b*. The housing 18*a*, 18*b* is tightly fixed to the underside of the supporting plate 11*b* by screws 19, the contact areas of both components being tightly fitted to each other in a manner impervious to compressed air by a liquid sealant (not shown). The work piece clamp 13*b* will be described in detail below.

The housing 18*b* includes a continuous cylindrical chamber 20, which is open downwards and closed upwards b y the supporting plate 11*b*, with a piston 21 disposed therein for sealed upward and downward reciprocating motion. This piston 21 has a piston rod 22 which stands out downwards from the cylindrical chamber 20 and is articulated by a hinge 23 to the corresponding end 24 of the bearing lever 16*b*. A compressed-air duct 25 is formed in the housing 18*b* by the side of the cylindrical chamber 20 and, on the upper side of the housing 18*b*, is connected to the cylindrical chamber 20 by an overflow duct 26. On the lower side of the housing 18*b*, a compressed-air line 27 opens into the compressed-air duct 25; the compressed-air line 27 is connected to an electromechanically operated 3/2-port directional control valve 28', a so-called solenoid valve. The described unit in the form of a unilaterally pneumatically actuated piston-cylinder unit constitutes a clamping drive 28*b*.

In the housing 18*b*, a hole 29 is provided by the side of the compressed-air duct 25 with a pre-loaded extension spring 30 disposed therein, which is fixed in place by a detaining pin 31 on the upper side of the housing 18*b* and by another detaining pin 32 on the bearing lever 16. By means of the pre-loaded extension spring 30, the bottom lever portion 33, between the pivot bearing 17*b* and the hinge 23. is pulled upwards towards the clamping drive 28*b* so that the top lever portion 34 of the bearing lever 16*b* is pivoted upwards i.e., the clamping plate 15*b* is lifted off the supporting plate 11*b*. If, however, compressed air flows into the chamber 20 above the piston 21 via the compressed-air line 27. the compressed-air duct 25 and the overflow duct 26, the piston 21. together with the bottom lever portion 33, is displaced downwards against the force of the extension spring 30 so that the top lever portion 34 and the clamping plate 15*b* are pivoted towards the supporting plate 11*b*, thereby possibly clamping a work piece 35.

A setscrew 36 is disposed in the bottom lever portion 33, bearing against the housing 18*b* and serving for adjustment of the length by which the clamping plate 15*b* is lifted off the bearing plate 14*b*.

Arranging the clamping drive 28*b* between the bearing lever 16*b* and the supporting plate 11*b* ensures that the forces that act within the work piece clamp 13*b* are kept within the clamp 13*b* and do not act on the x-y table 8. The other supporting plate 11*a* and the work piece clamp 13*a* are embodied in like manner.

In a zero position, the sectional supporting plates 11*a*, 11*b* are symmetrical to a center plane 37 so that opposite edges 38*a*, 38*b* of the bearing plates 14*a*, 14*b* have a distance z of for instance 6 millimeters between them. In this plane 37, a stationary knife 39 for buttonhole-40 cutting is arranged on the base plate 2 of the sewing machine. This knife 39 is part of a cutting device 41 which also includes an anvil 42 which is movable by a cutting drive 43, reciprocating up and down on the bottom side of the arm 1.

Figure 6:
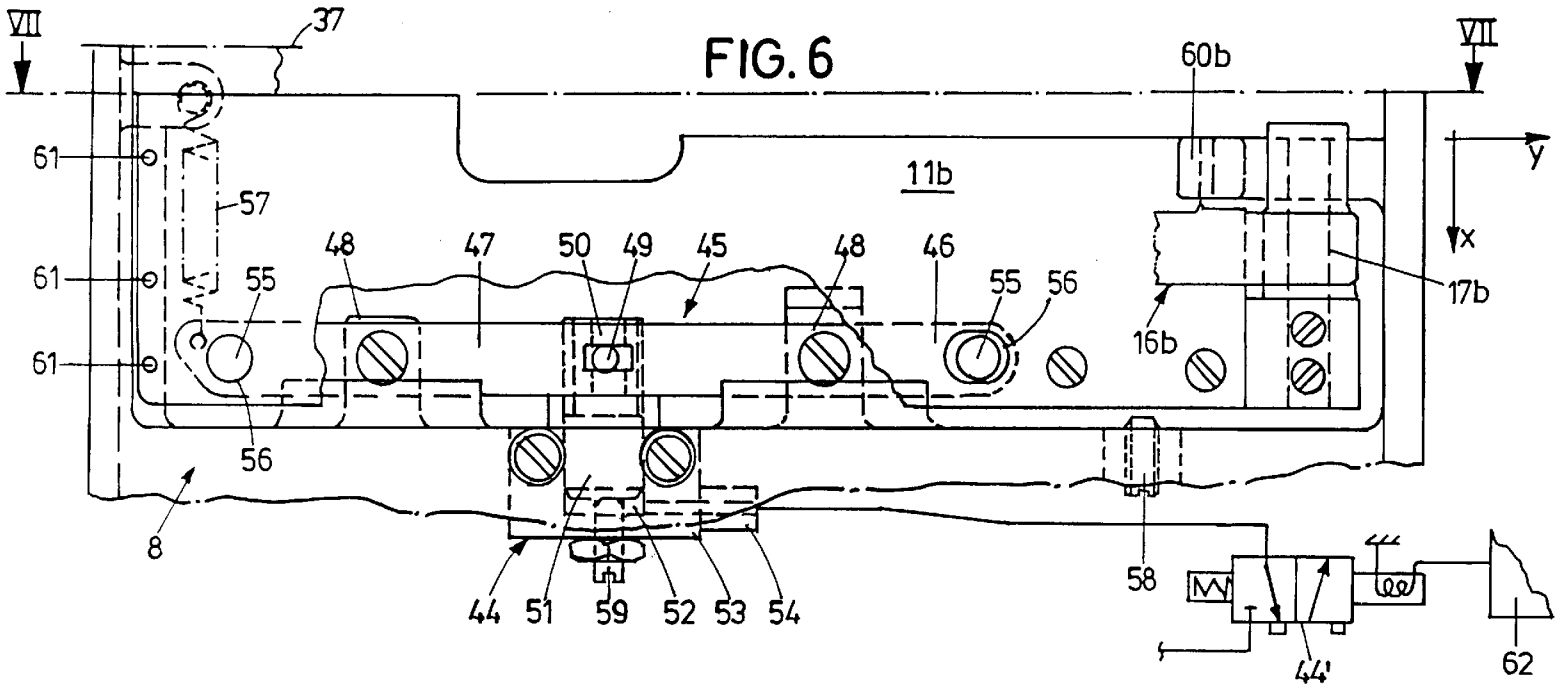
FIG. 6 is a partial plan view of the sewing machine in accordance with the arrow VI of FIG. 3.
Figure 7:
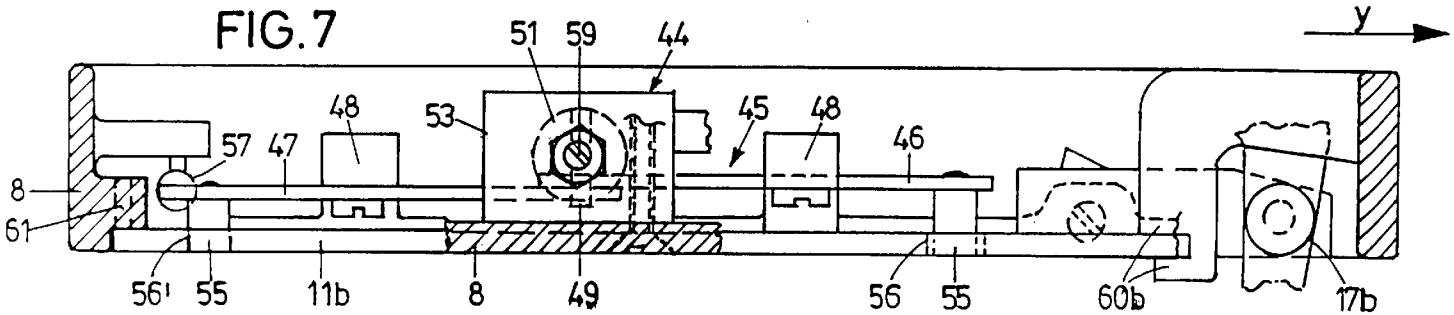
FIG. 7 is a vertical section of the sewing machine on the line VII—VII of FIG. 6.

A design of a displacement drive for the sectional supporting plate 11*b* will become apparent from FIGS. 6, 7. The sectional supporting plate 11*b* is guided for displacement directly on the x-y table 8. A pneumatically actuated displacement drive 44 is fixed to the x-y table 8 underneath the supporting plate 11*b*. It is coupled with a lever arrangement 45 which confers the shifting motions to the sectional supporting plate 11*b*. To this end, a first lever 46 and a second lever 47, which are both double-armed levers, are pivotably housed by their central portion in bearings 48 which are formed on the x-y table 8. The levers 46, 47 overlap one another at their ends turned towards each other; these ends have U-shaped recesses that run in the lengthwise direction of the levers 46, 47 (FIG. 6). This is where a bolt 49 passes through; the bolt 49 is provided on the drive 44 which is perpendicular to the principal direction of the levers 46. 47. The bolt 49 is mounted on a piston rod 50 of the drive 44, the piston rod 50 being joined to the piston 51 of the drive 44. The piston 51 is displaceably disposed in the interior space 52 of the casing 53 of the drive 44. A compressed-air supply line 54 with an electromechanically actuated 3/2-port direction control valve 44' located therein opens into the space 52.

The ends of the levers 46, 47 that face away from each other are provided with a pin 55, one pin 55 reaching into an oblong hole 56 and the other pin 55 into a circular hole 56' in the sectional supporting plate 11*b*. A preloaded extension spring 57. which is connected with the x-y table 8, acts on the end, neighboring the pin 55, of the second lever 47.

When the displacement drive 44 is actuated by compressed air, then the bolt 49 and the two ends, coupled therewith, of the levers 46, 47 are displaced counter to the x direction, as a result of which the sectional supporting plate 11*b* is shifted in the x direction against the pre-load of the extension spring 57. Upon pressure relief of the displacement drive 44, the sectional supporting plate 11*b* is restored by the extension spring 57 counter to the x direction.

Attached to the x-y table 8 is a first setscrew 58 as an adjustable stop, by means of which to define and set a first stop position of the sectional supporting plate 11*b* in the x direction. A second setscrew 59 is provided as an adjustable stop on the displacement drive 44, defining the restoring path of the piston 51 in the x direction, which again defines a second stop position of the sectional supporting plate 11 counter to the x direction. The two setscrews 58, 59 serve to define the stop positions and thus the length of displacement of the sectional supporting plate 11*b*.

The sectional supporting plate 11*b*, which is made of steel, is secured on the x-y table 8 in the vertical direction by engaging from below with a nose 60*b* on one side while being held by permanent magnets 61 on the side neighboring the extension spring 57. The sectional supporting plate 11*a* is likewise held on the x-y table 8 by a nose 60*a* and corresponding permanent magnets.

The sewing machine is provided with a control unit 62, by way of which are triggered the x drive 9, the y drive 10, the valve 44' for the displacement drive 44, the driving motor 5 of the arm shaft 4, the clamping drives 28*a*, 28*b* and the cutting drive 43. The control unit 62 includes a memory unit 63. An operating unit 64 with a keyboard 65 and a display 66 are allocated to the control unit 62.

Programs and data are stored in the memory unit 63, relating to a buttonhole seam 67 that is going to be produced. Ranges of values are stored for the distance z; they are allocated to the final positions of spread which are to be taken by the sectional supporting plate 11*b*.

Before a sewing job is started. the x-y table 8 is conventionally moved, in accordance with the data stored in the memory unit 63, into the zero position by the drives 9, 10 in the form of stepper motors; in the zero position the center plane 37 also accommodates the needle 7 in its vertical central position. Zero positioning of this type is general practice in sewing control technique and does not require any further explanation. By corresponding actuation of the operating unit 34, the operator selects a certain type of buttonhole 40 with a buttonhole seam 67.

This is followed by an adjustment job made by the operator for the spreading motion. To this end, a certain key of a keyboard 65 is operated in the operating unit 64, by which to move the sectional supporting plate 11*b* alternately into the first or second stop position. It is thus possible to adjust the respectively unloaded setscrew 58 or 59. This job is repeated until the given values of the distance z can be measured at the edges 38*a*, 38*b* of the bearing plates 14*a*, 14*b* by the aid of a slide gauge.

The adjustment job is accompanied with a transfer, by the operator, of given data of spread to the displacement drive 44 which positions the sectional supporting plate 11*b*. In the reverse case it is also possible, in the memory unit 63, to store data of spread i.e., values for the stop positions of the sectional supporting plate 11*b*, that have been determined empirically.

After termination of the adjustment job, a key of the operating unit 64 is actuated and, by the displacement drive 44 being triggered, the sectional supporting plate 11*b* and the work piece clamp 13*b* are moved into an initial position of spread in which the longitudinal edges 38*a*, 38*b*, defining the sectional openings 68*a*, 68*b*, of the clamping plates 15*a*, 15*b* have a distance a, corresponding to the distance z, from each other that corresponds to the total width b of the buttonhole seam 67 plus a distance c of for instance 0.5 mm between the buttonhole seam 67 and each neighboring longitudinal edge 38*a* and 38*b*.

Figure 9:
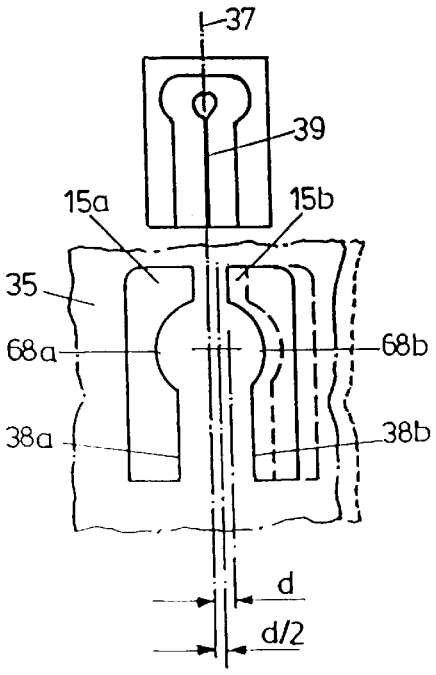
FIG. 9 is a plan view of parts of the sewing machine on an enlarged scale as opposed to FIG. 2.
Figure 10:
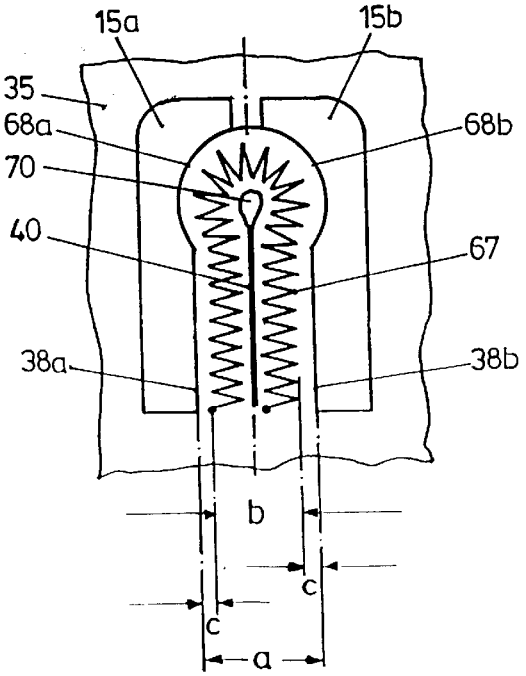
FIG. 10 is a plan view of a work piece with an eyelet buttonhole.
Figure 11:
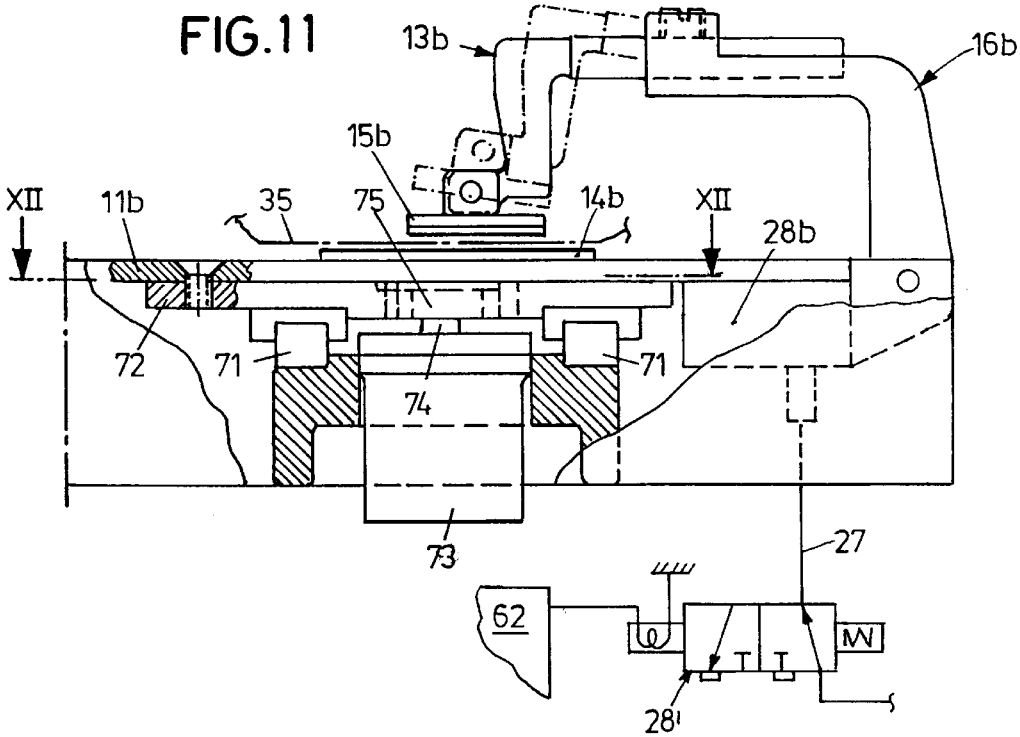
FIG. 11 is an illustration, partially broken open, of details of another embodiment of a sewing machine on an enlarged scale as compared to FIG. 1.
Figure 12:
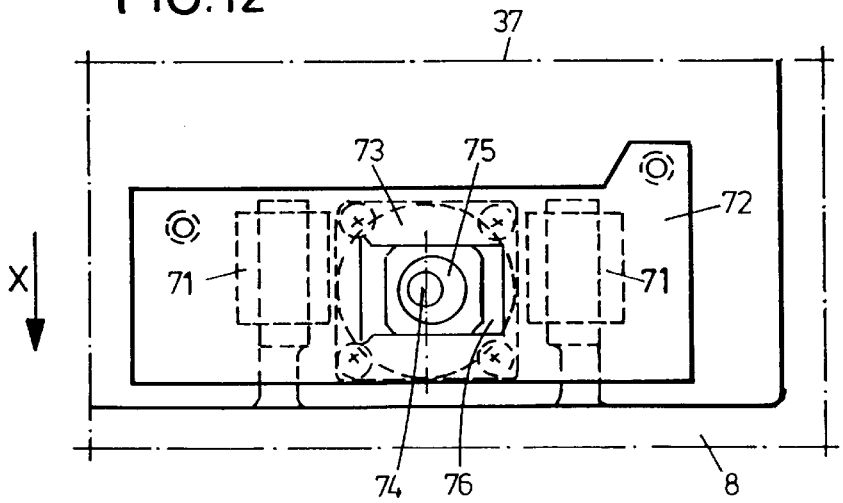
FIG. 12 is a plan view of the part of the sewing machine seen in FIG. 11 on the line XII—XII of FIG. 11.

Then the operator releases the work piece clamps 13*a*, 13*b* via the operating unit 64 or automatically in accordance with the stored sewing program; the operator may then place and align the work piece 35 on the bearing plates 14*a*, 14*b*. Subsequently, the work piece clamps 13*a*, 13*b* are closed by corresponding triggering of valves 28'for actuation of the clamping drives 28*a* and 28*b* so that the work piece 35 is clamped by both work piece clamps 13*a*, 13*b*. Afterwards, displacement of the sectional supporting plate 11*b*, together with the work piece clamp 13*b*, in the x direction by the length of spread d that results from the set stop positions takes place fully automatically by means of the displacement drive 44 which is triggered by the control unit 62. Simultaneously or directly afterwards, the x-y table 8 is moved by a length d/2 in the reversed direction so that the two bearing plates 14*a*, 14*b* are in their final position of spread again in mirror symmetry to the center plane 37. As a result, the sectional openings 68*a*, 68*b* are again in mirror symmetry to the center plane 37. The clamped and spread work piece 35 is positioned underneath the needle 6 in a position that is precisely defined for execution of the sewing operation. Solid lines in FIG. 9 illustrate the initial position of the clamping plate 15*b* and dashed lines show the position of spread after displacement of the sectional supporting plate 11*b* by the length of spread d but prior to compensation through reversal of the x-y table 8 by half the length of spread d/2. Cutting the buttonhole 40 by means of the knife 39 may take place prior to the buttonhole-40 sewing job or afterwards. As seen in FIG. 10, the buttonhole seam 67 is a conventional flat stitch seam produced by a corresponding needle jogging drive of the needle bar 6. Stay stitches (not shown) may be sewn additionally at the end of the buttonhole seam 67 that is opposite the buttonhole eye 70. FIGS. 11 and 12 illustrate an alternative embodiment for displacing the supporting plate 11*b*. In this case, a carrier plate 72, which carries the supporting plate 11*b*, is displaceably supported by a ball bearing guide 71. The carrier plate 72, along with the sectional supporting plate 11*b*, is displaceable in the x direction by means of a displacement drive 73 in the form of a stepper motor. This drive 73 is mounted on the x-y table 8, acting on the carrier plate 72 via a cam 75 that is mounted on its shaft 74 and a fulcrum slide connection 76 that cooperates with the cam 75, so that maximal displacements of the carrier plate 72 in the x direction are possible, corresponding to twice the eccentricity of the cam 75. The displacement lengths are in the range of approximately 2 mm. The spreading operation takes place as specified above; the length of spread d is controlled by data deposited in the memory unit 63.

What is claimed is:

1. A buttonhole sewing machine comprising a needle (7) drivable via an arm shaft (4);

an x-y table (8), which is movable by an x drive (9) in an x direction and by a y drive (10) in a y direction, which supports a first and a second work piece clamp (13*a*, 13*b*) mounted for displacement one relative to the other, and which comprises a displacement drive (44, 73) for displacing the work piece clamps (13*a*, 13*b*) relative to each other from an initial position of spread by a length of spread (d) into a final position of spread;

wherein at least the first work piece clamp (13*b*) comprises a supporting plate (11*b*) for accommodation of a work piece (35) and a clamping plate (15*b*) which is mounted on the supporting plate (11*b*); and wherein a clamping drive (28*b*) for actuation of the clamping plate (15*b*) supports itself on the supporting plate (11*b*).

2. A buttonhole sewing machine according to claim 1, wherein the clamping drive (28*b*) is a pneumatic piston-cylinder drive.

3. A buttonhole sewing machine according to claim 2, wherein the clamping drive (28*b*) comprises a drive housing (18*b*), which is mounted on the supporting plate (11*b*) and includes a cylindrical chamber (20) in which a piston (21) that is joined to a bearing lever (16*b*) is displaceably arranged, the bearing lever (16*b*) supporting the clamping plate (15*b*).

4. A buttonhole sewing machine according to claim 2, wherein the clamping drive (28*b*) is a unilaterally actuated piston-cylinder drive.

* * * * *